US009212564B2

(12) United States Patent
Langlois et al.

(10) Patent No.: US 9,212,564 B2
(45) Date of Patent: Dec. 15, 2015

(54) ANNULAR ANTI-WEAR SHIM FOR A TURBOMACHINE

(71) Applicant: SNECMA, Paris (FR)

(72) Inventors: Arnaud Langlois, Vaux le Penil (FR); Kamel Benderradji, Livry sur Seine (FR); Alain Marc Lucien Bromann, Vulaines sur Seine (FR); Vincent Roy, Soisy sur Seine (FR)

(73) Assignee: SNECMA, Paris (FR)

( * ) Notice: Subject to any disclaimer, the term of this patent is extended or adjusted under 35 U.S.C. 154(b) by 424 days.

(21) Appl. No.: 13/761,458

(22) Filed: Feb. 7, 2013

(65) Prior Publication Data

US 2013/0209249 A1 Aug. 15, 2013

(30) Foreign Application Priority Data

Feb. 9, 2012 (FR) ..... 12 51249

(51) Int. Cl.
*F01D 9/04* (2006.01)

(52) U.S. Cl.
CPC *F01D 9/04* (2013.01); *F01D 9/042* (2013.01); *F05D 2300/171* (2013.01); *F05D 2300/501* (2013.01)

(58) Field of Classification Search
CPC ..... F01D 11/00; F01D 11/003; F01D 11/005; F01D 11/006; F01D 11/008; F01D 9/00; F01D 9/02; F01D 9/04; F01D 9/042; F01D 25/24; F01D 25/246; F01D 25/243; F01D 25/28; F01D 5/22; F01D 5/10; F01D 5/26; F01D 5/00; F01D 5/3092; F04D 29/668; F05D 2240/57; F05D 2240/10; F05D 2240/11
See application file for complete search history.

(56) References Cited

U.S. PATENT DOCUMENTS

| | | | | | |
|---|---|---|---|---|---|
| 4,199,151 | A * | 4/1980 | Bartos | 277/306 |
| 5,333,995 | A * | 8/1994 | Jacobs et al. | 415/209.2 |
| 5,738,490 | A * | 4/1998 | Pizzi | 415/139 |
| 5,988,975 | A * | 11/1999 | Pizzi | 415/139 |
| 6,076,835 | A * | 6/2000 | Ress et al. | 277/637 |
| 6,299,178 | B1 * | 10/2001 | Halling | 277/654 |

(Continued)

FOREIGN PATENT DOCUMENTS

| | | |
|---|---|---|
| EP | 1 323 898 A2 | 7/2003 |
| FR | 2 938 872 A1 | 5/2010 |

(Continued)

OTHER PUBLICATIONS

French Preliminary Search Report issued Nov. 19, 2012, in French 1251249, filed Feb. 9, 2012 (with English Translation of Categories of Cited Documents).

*Primary Examiner* — Nathaniel Wiehe
*Assistant Examiner* — Eldon Brockman
(74) *Attorney, Agent, or Firm* — Oblon, McClelland, Maier & Neustadt, L.L.P.

(57) ABSTRACT

A turbomachine compressor or turbine including annular anti-wear shims mounted against hooks of a stator, each shim being substantially of channel-section defining an annular groove for engaging on a hook, the shim mounted against the downstream hook bearing axially via its middle annular wall on the stator, or on the casing, and one of its side walls includes a bearing device at its end remote from the middle annular wall for bearing against the casing or the stator, respectively, which bearing device is elastically deformable in an axial direction so as to urge the stator upstream.

12 Claims, 2 Drawing Sheets

(56) References Cited

U.S. PATENT DOCUMENTS

| | | | | |
|---|---|---|---|---|
| 6,568,903 | B1 * | 5/2003 | Aksit et al. | 415/191 |
| 7,201,381 | B2 * | 4/2007 | Halling | 277/604 |
| 7,207,771 | B2 * | 4/2007 | Synnott et al. | 415/173.1 |
| 7,217,089 | B2 * | 5/2007 | Durocher et al. | 415/174.2 |
| 7,238,003 | B2 * | 7/2007 | Synnott et al. | 415/139 |
| 8,016,297 | B2 * | 9/2011 | Heinemann et al. | 277/644 |
| 8,038,389 | B2 * | 10/2011 | Arness et al. | 415/190 |
| 8,092,159 | B2 * | 1/2012 | Maldonado | 415/173.1 |
| 8,419,361 | B2 * | 4/2013 | Robertson | 415/209.2 |
| 8,491,259 | B2 * | 7/2013 | Sutcu | 415/173.7 |
| 8,899,914 | B2 * | 12/2014 | Ring | 415/119 |
| 2004/0041351 | A1 * | 3/2004 | Beeck et al. | 277/503 |
| 2005/0242522 | A1 * | 11/2005 | Lejars | 277/584 |
| 2006/0045745 | A1 * | 3/2006 | Synnott et al. | 416/219 R |
| 2006/0159549 | A1 * | 7/2006 | Durocher et al. | 415/170.1 |
| 2008/0053107 | A1 * | 3/2008 | Weaver et al. | 60/800 |
| 2009/0243228 | A1 * | 10/2009 | Heinemann et al. | 277/595 |
| 2010/0068050 | A1 * | 3/2010 | Hansen et al. | 415/209.3 |
| 2010/0247286 | A1 * | 9/2010 | Maldonado | 415/1 |
| 2011/0049812 | A1 * | 3/2011 | Sutcu | 277/603 |
| 2012/0119449 | A1 * | 5/2012 | Demiroglu et al. | 277/652 |
| 2013/0113168 | A1 * | 5/2013 | Lutjen et al. | 277/644 |
| 2013/0177400 | A1 * | 7/2013 | Ring | 415/119 |

FOREIGN PATENT DOCUMENTS

| | | | |
|---|---|---|---|
| GB | 2 249 356 | A | 5/1992 |
| GB | 2477825 | A | 8/2011 |
| WO | WO 97/44570 | A1 | 11/1997 |

* cited by examiner

ANNULAR ANTI-WEAR SHIM FOR A TURBOMACHINE

BACKGROUND OF THE INVENTION

1. Field of the Invention

The invention relates to an annular anti-wear shim for a turbomachine, in particular for an annular hook of a turbomachine stator, nozzle, or casing.

2. Description of the Related Art

A guiding stator or nozzle in a turbomachine comprises an annular row of stationary vanes extending radially between an inner annular platform and an outer annular platform, the outer platform having two annular hooks, one upstream and the other downstream, that co-operate with corresponding hooks of a casing or of a shroud carried by the casing of the turbomachine.

In operation, as a result of micromovements generated by vibration and by differential thermal expansion of the parts, the hooks of the stator and of the shroud or casing can become worn by rubbing against each other. In order to remedy the problem of the hooks suffering wear by rubbing, it is known to engage an annular anti-wear shim of channel section on each of the hooks so as to eliminate any direct contact between the hooks. The shim is made of a material that wears more easily in rubbing than the materials of the hooks, and it is intended to be replaced during a maintenance operation once it has becomes too worn.

Applications FR 2 938 872 and FR 10/59696 in the name of the Applicant describe annular anti-wear shims of this type.

In order to optimize the performance of the turbomachine, it is important to provide good radial sealing upstream from the stators of the compressor (or the nozzles of the turbine) between the upstream end of the outer platform of each stator and the facing downstream end of the shroud of the casing situated upstream from the stator. This makes it possible to avoid recirculation upstream from the stator, where such recirculation would reduce the performance and the operability of the turbomachine.

In the prior art, it is known to provide such sealing by having the upstream end of the outer platform of the stator bear axially against the downstream end of the shroud situated upstream, this axial bearing being maintained by an undulating ring that is elastically deformable in the axial direction and that is mounted downstream from the downstream hook of the stator. The ring is mounted with prestress in the axial direction in a housing of the casing or of a shroud and it bears axially against the downstream hook of the stator in order to urge the stator upstream and to keep it bearing in sealed axial manner against the upstream shroud.

However, that technology cannot be used in all engines, in particular in engines of small size, since it is too bulky. This applies in particular when the location in the downstream shroud that is to receive a ring of this type is already occupied by other elements such as vibration dampers.

BRIEF SUMMARY OF THE INVENTION

An object of the invention is to provide a solution to this problem that is simple, effective, and inexpensive.

To this end, the invention provides a turbomachine compressor or turbine having an annular casing with at least one stator or nozzle fastened therein, the stator or nozzle having upstream and downstream annular hooks co-operating with corresponding hooks of the casing or of a shroud carried by the casing, annular anti-wear shims being mounted against the upstream and downstream hooks of the stator, each shim being substantially of channel section, defining an annular groove for engaging on a hook with two substantially parallel annular side walls extending one inside the other and connected together by a middle annular wall or "web", wherein the shim mounted against the downstream hook bears axially via its web on the stator, or on the casing, and one of its side walls includes bearing means at its end remote from the web for bearing against the casing or the stator, respectively, which bearing means are elastically deformable in an axial direction so as to urge the stator upstream.

The anti-wear shim of the invention may then be prestressed axially against the downstream hook of a stator or a nozzle, with the thrust force that results from this prestress being sufficient to urge the stator upstream and to keep it bearing axially against an upstream shroud, thereby providing sealing in a radial direction in this bearing plane.

As a result, in addition to its anti-wear function, the anti-wear shim also incorporates a resilient thrust function when it is axially prestressed. This function is provided by the resilient means carried by one of the side walls of the shim.

These resilient means are preferably formed integrally with the shim, which is shaped for example by stamping, and which may be sectorized, i.e. made up of a plurality of shim sectors arranged circumferentially end to end. The shim may have thickness lying in the range 0.1 millimeters (mm) to 0.5 mm, e.g. in the range 0.2 mm to 0.3 mm. It may be made of steel or of inconel.

In a preferred embodiment of the invention, the above-mentioned side wall includes an annular rim at its end remote from the web, which rim extends outwards from the groove and co-operates with the outer annular face of said side wall to define an angle lying in the range 30° to 150°, preferably in the range 90° to 140°, and more preferably in the range 100° to 130°.

Preferably, the annular rim has a free peripheral edge that is of shape that is rounded in section, with its convex surface facing away from the web and defining a bearing surface. This avoids a sharp edge of the rim bearing against the casing or the stator, and thus limits any risk of the casing or the stator being damaged as a result of this bearing surface.

The annular rim of the shim may be sectorized. For this purpose, a plurality of slots may be formed in the rim, these slots extending substantially along the entire axial dimension of the rim and defining between them rim sectors that are elastically deformable independently of one another. This makes it possible to make the rim more flexible in the axial direction, i.e. to reduce the force needed for elastically deforming the rim in the axial direction.

The bearing means may be carried by the inner side wall or by the outer side wall of the shim. When they are carried by the inner wall, these resilient means extend radially inwards from the inner wall. When they are carried by the outer wall, the resilient means extend radially outwards from the outer wall.

The present invention also provides a turbomachine compressor or turbine having an annular casing with at least one stator or nozzle fastened therein, the stator or nozzle having upstream and downstream annular hooks co-operating with corresponding hooks of the casing or of a shroud carried by the casing, annular anti-wear shims being mounted against the upstream and downstream hooks of the stator, wherein the annular shim mounted against the downstream hook is as defined above, said shim bearing axially via its web against the stator or against the casing, and via its bearing means against the casing, or against the stator, respectively, so as to urge the stator upstream.

The shim may be engaged on the downstream hook of the stator and it may bear axially via its bearing means against the stator. The shim is also received in an annular groove of the casing or of the shroud carried by the casing, and its web bears against the bottom of the groove.

In a variant, the shim is engaged on a downstream hook of the casing or of the shroud carried by the casing and bears axially via its bearing means against the casing or the shroud. The shim is also received in an annular cavity of the stator with the web of the shim bearing against the bottom of the cavity.

Finally, the present invention provides a turbomachine such as an airplane turboprop or turbojet, including a compressor or a turbine as described above.

BRIEF DESCRIPTION OF THE SEVERAL VIEWS OF THE DRAWINGS

The invention can be better understood and other details, advantages, and characteristics of the invention appear more clearly on reading the following description made by way of non-limiting example and with reference to the accompanying drawings, in which.

DETAILED DESCRIPTION OF THE INVENTION

Figure 1:
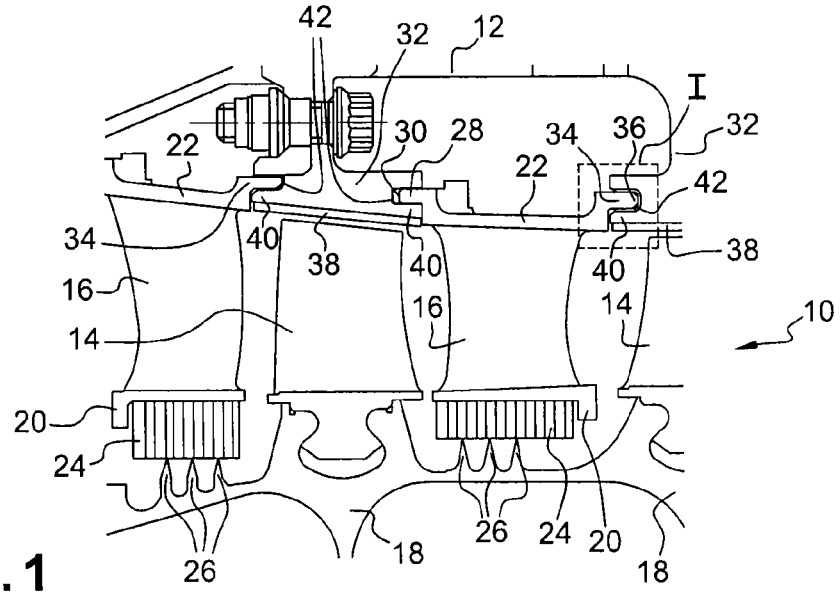
FIG. 1 is a fragmentary diagrammatic half-view in axial section of a prior art compressor of a turbomachine.

Reference is made initially to FIG. 1, which shows a portion of a high pressure compressor 10 of a turbomachine that has a plurality of compression stages mounted in a casing 12. Each stage comprises a wheel carrying an annular row of movable blades 14 and a downstream stator comprising an annular row of stationary vanes 16. The wheels of the compression stages have disks 18 that are connected to the compressor shaft 10 of the turbomachine. The stationary vanes 16 of each stator extend radially between an inner platform 20 and an outer platform 22. The inner platforms 20 of the stators carry an abradable material 24 on their inner surfaces, which material co-operates with wipers 26 carried by the rotor of the compressor.

Figure 1A:
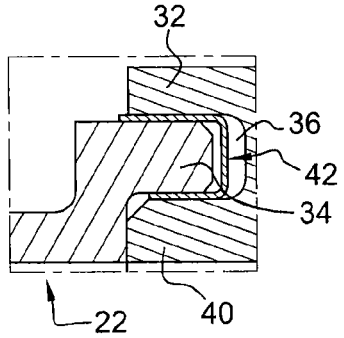
FIG. 1*a* is a larger-scale view showing a detail I of FIG. 1.

The outer platform 22 of each stator has an upstream annular hook 28 that is engaged in an annular groove 30 that faces downstream and that is formed in a shroud 32 carried by the casing 12. The outer platform 20 also has a downstream annular hook 34 that is engaged in an annular groove 36 facing upstream in another shroud 32 carried by the casing 12 (FIG. 1*a*).

Each shroud 32 carried by the casing 12 surrounds a wheel of the compressor and includes on its radially inner face a layer 38 of abradable material for co-operating with the ends of the movable blades 14 of the corresponding wheel.

Each annular groove 30, 36 co-operates with the inner face of the corresponding shroud 32 to define an annular hook 40 around which there extends a hook 28, 34 of the stator.

An annular anti-wear shim 42 of channel section is mounted on each of the upstream and downstream hooks 28 and 38 of each stator so as to eliminate any direct contact between the hooks 28, 38 and the corresponding shroud 32, thereby increasing the lifetime of the stators and of the shrouds.

The anti-wear shims 42 in the prior art do not guarantee sealing between the stators and the shrouds, and in particular they do not guarantee radial sealing upstream from the stators between their upstream hooks and the corresponding shrouds, thereby creating air recirculation zones upstream from the stators.

In order to remedy that drawback, proposals have already been made to urge the upstream end of the outer platform 22 of each stator to bear axially against the downstream end of the corresponding shroud 32, with this axial bearing sufficing to guarantee radial sealing upstream from the stators.

Figure 2:
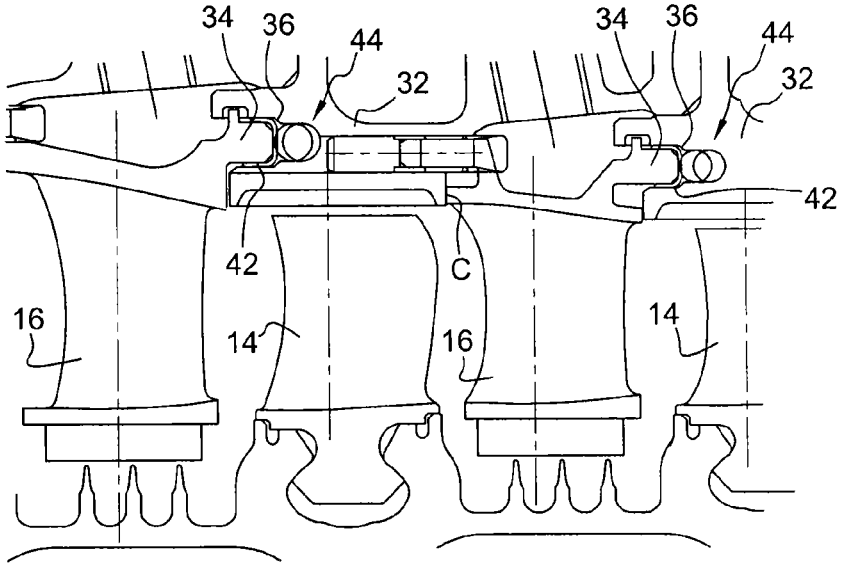
FIG. 2 is a fragmentary diagrammatic half-view in axial section of another prior art compressor of a turbomachine.

For this purpose, and as shown in FIG. 2, an undulating ring 44 that is elastically deformable in the axial direction is mounted with prestress in the bottom of the groove 36 of each shroud 32 and bears respectively against the downstream end of the downstream hook 34 and against the bottom of the groove 36 in order to exert a thrust force on the stator and urge it axially upstream. The axial force exerted by the ring 44 on the stator is sufficient to keep the upstream end of the platform 22 bearing axially at C against the downstream end of the shroud 32 situated upstream from the stator.

Nevertheless, that technology cannot always be applied, in particular in engines of small size.

The invention enables that problem to be remedied by incorporating a resilient return function in an anti-wear shim of the above-mentioned type.

Figure 3:
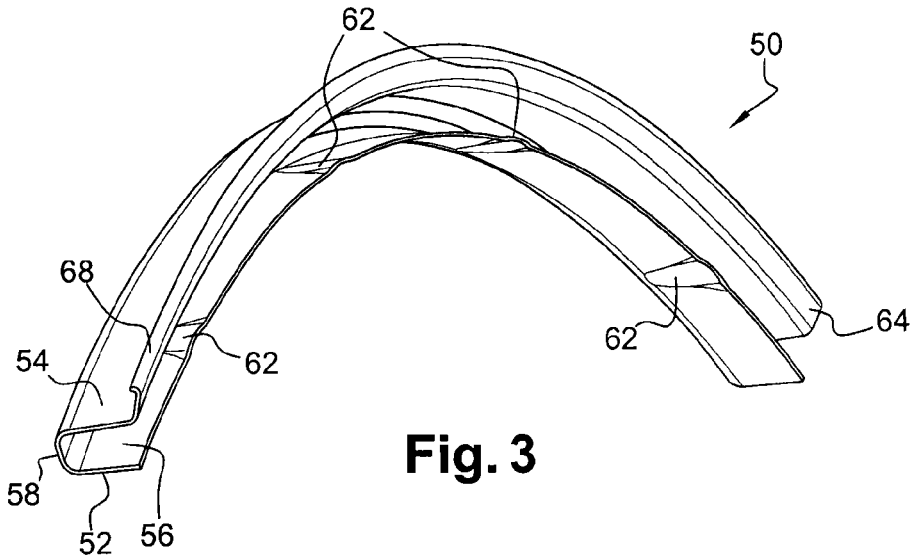
FIG. 3 is a diagrammatic perspective view of a sector of an annular anti-wear shim of the invention.
Figure 4:
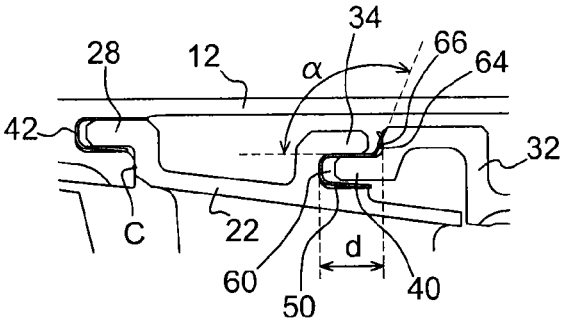
FIGS. 4 and 5 are fragmentary diagrammatic views in axial section of turbomachine stators, each fitted with an anti-wear shim of the invention.

FIGS. 3 and 4 show a first embodiment of the annular anti-wear shim of the invention. This shim 50 is substantially of channel section and has two side walls extending one inside the other, respectively an inner wall 52 and an outer wall 54, these walls defining between them an annular groove 56 for engaging a hook, and being connected together at one of their axial extends by a middle wall or "web" 58.

As shown in FIG. 4, each stator is associated with a single shim 50 of the invention that is mounted on its downstream hook 34, while its upstream hook 28 is associated with a conventional shim 42 of the prior art.

The downstream hook 34 of the FIG. 4 stator is engaged on an upstream annular hook 40 of a shroud 32 carried by the casing 12, this hook 40 extending in an annular cavity 60 of the stator that is defined between the hook 34 and the outer platform 22 of the stator and that opens out downstream.

The inner wall 52 of the shim 50 is interposed between the inner cylindrical face of the hook 40 of the shroud 32 and an outer cylindrical surface of the outer platform 22 of the stator, which surface is the inner cylindrical surface of the cavity 60 in the stator. As can be seen in FIG. 3, the inner wall 52 of the shim 50 has bulges 62 projecting towards the inside of the channel-section and regularly distributed around the longitudinal axis of the shim.

The bulges 62 bear radially against the inner cylindrical surface of the hook 40 of the shroud, and the remainder of the inner wall 52 of the shim 50 bears against the inner cylindrical surface of the cavity 60, thereby enabling the inner wall 52 to be clamped radially, and enabling the shim to be held in position.

The web 58 of the shim bears axially upstream against the bottom of the cavity 60 of the stator.

The outer wall 54 of the shim is interposed between the outer cylindrical face of the hook 40 of the shroud 32 and an inner cylindrical surface of the hook 34 of the stator, which surface constitutes the outer cylindrical surface of the cavity 60.

The wall 54 has an annular rim 64 at its downstream end projecting radially outwards, this rim 64 being elastically deformable in the axial direction and including at its outer periphery a downstream annular surface 68 for bearing against a radial annular surface 66 of the shroud 32.

In the example shown, the rim 64 is inclined outwards on going from upstream to downstream and it co-operates with the outer face of the wall 54 of the shim 50 to define an angle $\alpha$ lying in the range 90° to 140°, and preferably in the range 100° to 130° (at rest).

The outer peripheral edge of the shim 50 is curved upstream and outwards and presents a curved C-shape in section, with its convex annular surface facing downstream and forming the above-mentioned bearing surface 68.

The shim 50 is engaged in the cavity 60 of the stator by moving in axial translation from downstream until its web 58 comes to bear axially against the bottom of the cavity 60. The stator is then attached to the shroud 32 of the casing by engaging its downstream hook 34 on the upstream hook 40 of the shroud. During this engagement, the hook 40 of the shroud engages in the groove 56 of the shim, and the rim 64 of the shim comes to bear via its downstream bearing surface 68 against the radial wall 66 of the shroud.

In the mounted position, the axial distance d between the bottom of the cavity 60 of the stator and the radial surface 66 of the shroud 32 is less than the length or axial dimension of the shim 50 at rest, this length being measured between the upstream annular bearing surface of the web 58 and the downstream bearing surface 68 of the rim 66 when the rim is not axially stressed.

During the above-mentioned engagement, the rim 64 of the shim deforms elastically, with its bearing surface 68 being moved upstream relative to the remainder of the shim as this surface 68 slides over the radial surface 66 of the shroud. The shim is thus mounted with axial prestress against the downstream hook 34 of the stator. In its prestressed position, the shim 50, which bears upstream via its web 58 against the stator and downstream via its rim 64 against the shroud, thus exerts an upstream axial force on the stator having the upstream end of its outer platform 22 held to bear axially at C against the downstream end of the shroud situated upstream from the stator. This axial force is equal to the resilient return force generated by the rim 64 of the shim as a result of being deformed, and by way of example it may be at most 580 newtons (N).

As can be seen in FIG. 3, the shim 50 may be sectorized in order to make it easier to put into place, the shim then comprising a plurality of shim sectors that, in the mounted position, are arranged circumferentially end to end, or slightly spaced apart circumferentially from one another. These shim sectors may be prevented from moving circumferentially relative to the stator and the shroud by bolts interposed between two adjacent sectors and co-operating with the stator or the shroud. When the stator is sectorized, these bolts may be the bolts that are used for preventing the stator sectors from turning relative to the shroud.

Figure 5:
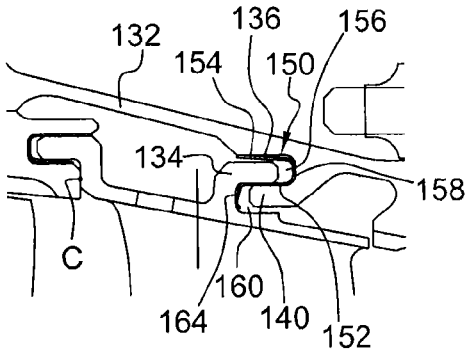

In the variant embodiment of the invention shown in FIG. 5, the anti-wear shim 150 mounted against the downstream hook 134 of the stator has elastically deformable bearing means that are carried by the inner wall 152 of the shim. These bearing means are similar to those described above. They are formed by an annular rim that extends radially inwards and upstream from the upstream end of the inner wall 152 that co-operates with the outer wall 154 to define a groove 156 that opens out upstream.

The shim 150 is engaged in an annular groove 136 of the shroud that opens out upstream by being moved axially from upstream until the web 158 of the shim comes to bear axially against the bottom of the groove 160. The stator is then attached to the shroud 132 of the casing by engaging its downstream hook 134 in the groove 156 of the shim 150 and on the upstream hook 140 of the shroud. During this engagement, the rim 164 of the shim comes to bear via its upstream bearing surface against the bottom of the cavity 160 of the stator and it deforms elastically. In the prestressed position, the shim 150, which is bearing upstream via its rim 164 on the stator and downstream via its web 158 on the shroud, exerts an upstream axial force on the stator, with the upstream end of its outer platform being held to bear axially at C against the downstream end of the shroud situated upstream from the stator.

Figure 6:
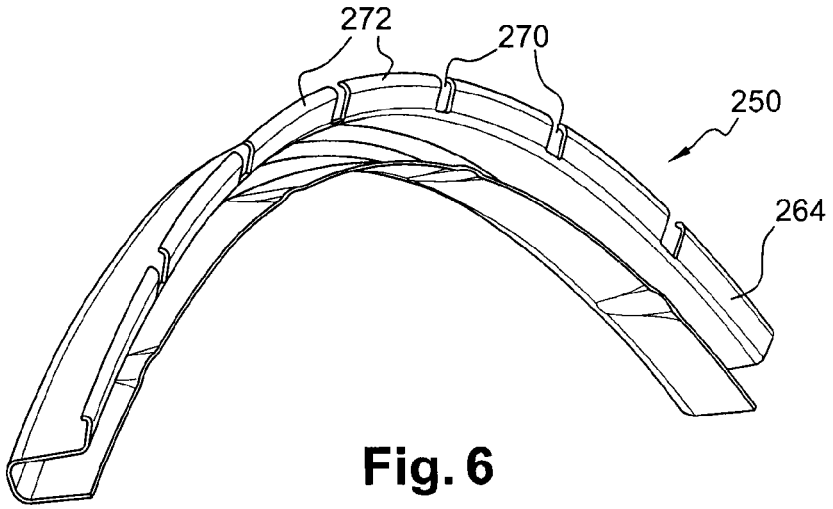
FIG. 6 is a diagrammatic view in perspective of a variant embodiment of an anti-wear shim sector of the invention.

The shim 250 of the variant embodiment shown in FIG. 6 differs from that shown in FIG. 3 essentially in that its rim 264 is sectorized. The rim 264 has a plurality of slots 270 that are regularly distributed around the axis of the shim and that define between them rim sectors 272 that are elastically deformable in the axial direction independently from one another. The slots 270 extend over substantially the entire axial dimension of the rim.

The invention claimed is:

1. A turbomachine compressor or turbine comprising:

an annular casing with at least one stator or nozzle fastened therein, the stator or nozzle having upstream and downstream annular hooks at an outer annular platform thereof co-operating with corresponding hooks of the casing or of a shroud carried by the casing, an inner annular platform, and an annular row of stationary vanes extending between the inner and outer platforms; and annular anti-wear shims being mounted against the upstream and downstream hooks of the stator, each shim being substantially of channel section, defining an annular groove for engaging on a hook of the casing or the shroud carried by the casing with annular inner and outer side walls which are substantially parallel and connected together by a middle annular wall, wherein the middle annular wall bears axially on the stator or on the nozzle when the shim is mounted against the downstream hook of the stator, and one of the inner and outer side walls includes bearing means at an end remote from the middle annular wall for bearing against the casing or the stator, respectively, which bearing means are elastically deformable in an axial direction so as to urge the stator upstream.

2. A compressor or turbine according to claim 1, wherein the one of the inner and outer side walls includes an annular rim at the end remote from the middle annular wall, which rim extends outwards from the groove and cooperates with the outer annular face of said side wall to define an angle ($\alpha$) lying in the range 90° to 140°.

3. A compressor or turbine according to claim 2, wherein the annular rim has a free peripheral edge that is of shape that is rounded in section, with a convex surface facing away from the middle annular wall and defining a bearing surface.

4. A compressor or turbine according to claim 2, wherein the annular rim is sectorized.

5. A compressor or turbine according to claim 2, wherein an axial distance between a bottom of a cavity of the stator or the nozzle and a radial surface of the shroud is less than an axial distance between an upstream bearing surface of the middle wall and a downstream surface of the rim when the shim is at rest.

6. A compressor or turbine according to claim 2, wherein the angle ($\alpha$) lies in the range 100° to 130°.

7. A compressor or turbine according to claim 1, wherein a portion of the shim is sectorized.

8. A compressor or turbine according to claim 1, wherein the bearing means are carried by the inner side wall or by the outer side wall.

9. A compressor or turbine according to claim 1, wherein the shim is engaged on the downstream hook of the stator or the nozzle and bears axially via the bearing means against the stator or the nozzle, and is also housed in an annular groove of the casing or of the shroud carried by the casing, the middle annular wall of the shim bearing against the bottom of the groove of the casing or of the shroud carried by the casing.

10. A compressor or turbine according to claim 1, wherein the shim is engaged on a downstream hook of the casing or of the shroud carried by the casing and bears axially via the bearing means against the casing or the shroud, and is also received in an annular cavity of the stator or the nozzle with the middle annular wall of the shim bearing against the bottom of the annular cavity of the stator or the nozzle.

11. A turbomachine including a compressor or a turbine according to claim 1.

12. A compressor or turbine according to claim 1, wherein the one of the inner and outer side walls is sandwiched between one of the hooks of the outer platform and a corresponding hook of the casing or of the shroud carried by the casing.

* * * * *